United States Patent [19]
Manina et al.
[11] 4,275,946
[45] Jun. 30, 1981

[54] ELECTRICAL CONNECTING PLUG

[76] Inventors: Mitch Manina, 11090 McBroom St., Sunland, Calif. 91040; William Lomenick, 16258 Stare St., Sepulveda, Calif. 91343

[21] Appl. No.: 39,670

[22] Filed: May 16, 1979

[51] Int. Cl.[3] ..... H01R 17/18

[52] U.S. Cl. ..... 339/183; 200/51.09; 339/14 P

[58] Field of Search ..... 339/14 P, 182 R, 182 RS, 339/183, 177 RG; 179/1 PC, 107, 96; 200/51.09, 51.11, 51.12

[56] References Cited

U.S. PATENT DOCUMENTS

| | | | |
|---|---|---|---|
| 420,183 | 1/1890 | Beach et al. | 200/51.09 |
| 2,640,118 | 5/1953 | Werner | 200/51.1 X |
| 2,664,475 | 12/1953 | Harlin | 200/51.1 |
| 3,158,702 | 11/1964 | Vanderbilt | 179/96 X |
| 3,225,155 | 12/1965 | Duncan | 339/183 X |
| 3,467,940 | 9/1969 | Wallo | 339/14 R |
| 3,600,531 | 8/1971 | Hoegerl | 200/51.1 |

*Primary Examiner*—Eugene F. Desmond
*Attorney, Agent, or Firm*—Richard H. Zaitlen

[57] ABSTRACT

A connector plug having special utility in the electrical musical instrument field is disclosed. The plug comprises a body having first and second elongated electrodes extending outwardly therefrom. The first electrode is slideably disposed in the second electrode and electrically isolated from the second electrode along the length thereof. Means are provided in the body for urging the distal ends of the first and second electrodes into electrical engagement in the rest position. When the plug is joined to an associated jack, however, the distal ends of the electrodes are caused to disengage so as to electrically isolate the electrodes from each other. By the use of the device of the present invention, problems of undesirable noise being generated when activating an electrical musical instrument or like device is substantially eliminated.

8 Claims, 8 Drawing Figures

ELECTRICAL CONNECTING PLUG

BACKGROUND OF THE INVENTION

1. Field of the Invention

This invention relates to electrical devices, and more particularly, to an electrical connector plug having special utility in the electrical musical instrument field.

2. Prior Art

The configuration and use of electrical connectors are extremely well known in the art. Such connectors can have a wide range of configurations depending on the ultimate use to which the connector is put. One type of connector which has gained wide acceptance is generally referred to as a "phonejack plug". This type of connector has a generally tubular body with an outwardly extending rod-like contact member. The contact member comprises inner and outer electrodes which are configured so as to be easily plugged into an associated receptacle. Such type of plugs are used, for example, in the communications field and especially in the musical instrument field.

Connectors of this sort are commonly employed for the detachable inter-connection of electrical impulse generating equipment with electrical translation systems of the sort commonly designated as public address systems. Such systems normally include means for amplifying impulses received from the generating equipment for broadcast purposes. In the past, plug-in jacks and the associated connectors, when used with sound generators and amplifiers, frequently caused the problems of undesirable squealing or screeching noises in the public address system, i.e., the speakers. In such prior art connectors, if the active electrode of the connector accidently came into contact with an electrified object during connection or disconnection, squealing or screeching would result. In fact, the mere accidental touching of the active electrode of a prior art connector by a person in handling the same often times resulted in the production of such undesirable noises in the broadcast system, since the person touching the active electrode constitutes an electrostatically charged object.

While this problem is well recognized in the art, the solution has been very evasive. This problem is especially acute in the performing arts. In such situations, when a musician desires to plug his electrical instrument into the amplifier or unplug the same, the connector presently used is such that during both insertion and withdrawal, the active tip often times causes extremely loud screeching noises to be heard, because of the scraping of the tip across the electrical connector in a jack. This can be very disconcerting to an audience, and is thought to be unprofessional. Thus, many musicians plug their instruments in before a performance and do not unplug them until the performance is over.

One type of device designed to alleviate some of these problems is disclosed in U.S. Pat. No. 2,664,475. In that patent, a specifically designed receptacle is used. The problem with such receptacle is that unless the amplifier, guitar, or other device already has the receptacle contained in it, it would be extremely difficult to modify such device so as to achieve the benefits of the specifically designed electrical receptacle set forth in the patent.

Other similar electrical connectors and the like are discussed in U.S. Pat. No. 2,640,118; 3,225,155; and 3,467,940.

While each of the devices disclosed in these patents do show various types of switching connectors and/or receptacles, they all contain a number of shortcomings. Thus, the total problem of noise being generated when attaching or disconnecting the connector plug still exists, and those devices which do address themselves to this problem are either not related to the plug or are extremely complex, or both.

The present invention is directed toward a connector plug which has a specific configuration designed to substantially eliminate the problems caused by having an active tip on the connector plug. In addition, the device of the present invention is straight forward in its design, relatively easy to manufacture, and contains none of the complex configurations or large sizes associated with prior art devices.

SUMMARY OF THE INVENTION

The present invention is directed to a connector plug specifically designed for use in connection with an electrical musical instrument, such as, for example, an electrical guitar, and with microphones in public address systems. However, it should be understood that the connector plug could be used in connection with other electrical musical instruments or in other situations wherein it is desirable to eliminate feed-back problems caused by having a connector plug with an electrically active tip.

The connector plug of the present invention comprises a non-conductive tubular body with first and second electrodes extending outwardly therefrom. The first electrode has a contact tip adjacent its distal end configured to form a contact with an associated jack. The second electrode circumferentially surrounds the first electrode in a coaxial configuration. The first electrode is slidably disposed within the second electrode and is electrically isolated therefrom along the length thereof by a specifically configured insulating member. The first electrode is joined to a spring member which urges the first electrode to remain electrically coupled to the second electrode adjacent the distal ends thereof in the initial or rest position.

When the connector plug of the present invention is joined to an associated jack, the first electrode extends outwardly from the second electrode thus becoming electrically isolated from it. However, because such contact area between the first electrode and the second electrode is only adjacent the distal ends thereof, and further because the separation of the two electrodes only occurs after interconnection with the jack is completed, noise associated with having a "hot" tip is eliminated. This is because during insertion and removal of the connector plug, electrical contact between the first and second electrodes is maintained. This grounds out any input to the amplifier and thus to the broadcast system. Thus, by the use of the device of the present invention, problems associated with feedback are substantially eliminated. Only when the plug is fully inserted into a particular instrument does it become activated.

The novel features which are believed to be characteristic of the invention, both as to its organization and method of operation, together with further objectives and advantages thereof will be better understood from the following description considered in connection with the accompanying drawings in which presently preferred embodiments of the invention are illustrated by way of examples. It is to be expressly understood, however, that the drawings are for the purpose of illustration and description only, and are not intended as a definition of the limits of the invention.

DETAILED DESCRIPTION OF THE INVENTION

Figure 1:
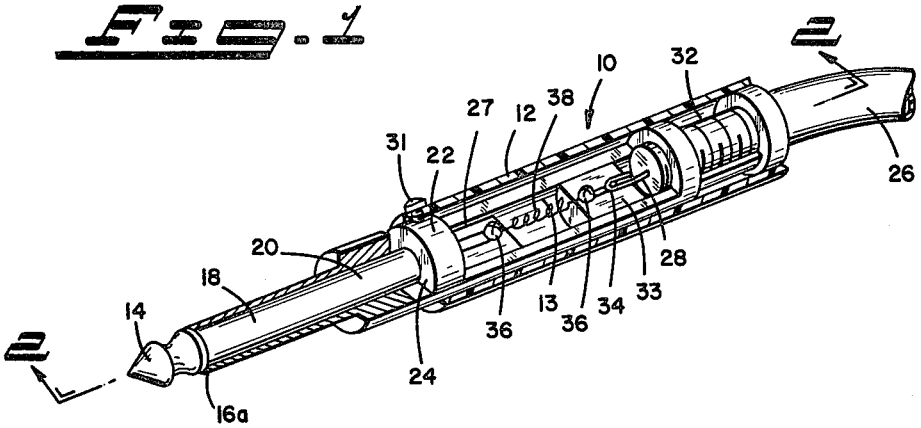
FIG. 1 is a partially cut-away perspective view of the first embodiment of the connector plug of the present invention.
Figure 2:
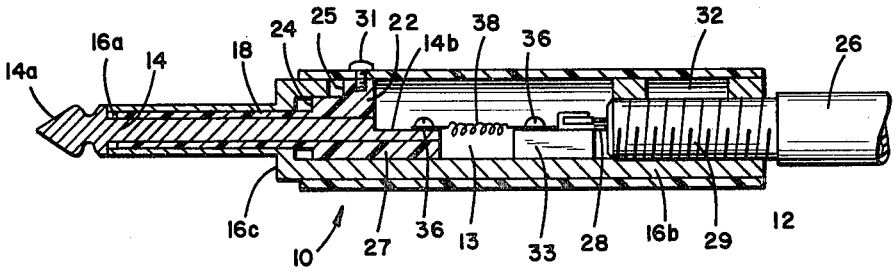
FIG. 2 is a cross-sectional view of FIG. 1 taken along lines 2—2 showing the internal aspects of the first embodiment of the present invention.

Referring first to FIGS. 1 and 2, the first embodiment of the device of the present invention is shown. As one can see, the first embodiment of the connector plug 10 is comprised of an elongated, non-conductive plastic body member 12 which forms a tubular housing for the other elements of the invention. A coaxial cable 26 extends into one end of the body 12 and first and second electrodes 14 and 16, respectively, extend out of the other end of the body 12. First electrode 14 has a generally rod-like shape and is slideably disposed within the second electrode 16. The first electrode 14 also has a specifically designed contact tip at its distal end 14*a*. One can see that the distal end 14*a* of first electrode 14 extends beyond the distal end 16*a* of the second electrode 16. The distal end 16*a* of the second electrode 16 is joined to a proximal end 16*b* by a flared shoulder section 16*c*. The proximal end 14*b* of the first electrode 14 is disposed within the elongated body 12. The second electrode 16 has a trough 13 formed along the length thereof into which the first electrode 14 extends.

Extending along the length of the first electrode 14 and circumferentially surrounding the same is a tubular insulator member 18. Insulator 18 is comprised of a tubular section 20 with a base 20 formed along the length thereof. First and second shoulders 24 and 25 are formed on the base 22 and are used to regulate the movement of the first electrode 14 as hereinbelow described. Another section 27 of the insulator 18 extends from the base 22 towards the center of the trough 13.

Referring further to FIGS. 1 and 2, one can see that a cable 26 extends into the trough 13 and a first conductor 28 extends from the cable 26 to an insulating platform 33 fixedly disposed in trough 13. The construction of cable 26 is well known in the art. Preferably, it has an inner conductor 28 and an exterior conductor 29. To hold the cable 26 in place, and to further electrically join the second electrode 16 to the cable 29, first and second metal ring members are integrally formed along the length of electrode 16. The connection between the first conductor 28 to the first electrode 14 is by means of a spring member 38. More specifically, in the preferred embodiment, conductor 28 is crimped to a coupling 34 located on the insulating platform 33. Screws 36 join the coupling 34 and spring member 38 to the first electrode 14. In this manner, an electrical path is formed between the first electrode 14 and conductor 28.

With respect to the conductor 29, such connection is perferably formed with ring members and the bottom of the trough 13 of the second electrode 16. In this manner, electrical insulation between the conductors 28 and 29 is maintained throughout the plug 10 except when distal ends 14*a* and 16*a* are in contact. It is to be understood, however, that many other means, such as, pins, couplings, and the like could be used to join connectors 28 and 29 to the first and second electrodes 14 and 16, respectively.

The body 12 is joined to the insulator 18 by means of screw 31. This is done in such a manner so as to permit the body 12 to move with respect to the second electrode 16 while maintaining electrical isolation along the length of the first and second electrodes 14 and 16, respectively. However, as clearly shown in FIGS. 1 and 2, in the initial position of the plug 10, the distal ends 14*a* and 16*a* remain in electrical contact. Thus, there is a connection between the conductors 28 and 29. In this manner the plug 10 is "shorted out" in the initial or rest position. Should one touch the distal end 14*a* (or any other portion of electrodes 14 or 16), no signal will travel along conductors 28 and 29 to an amplifier or the like.

Figure 3:
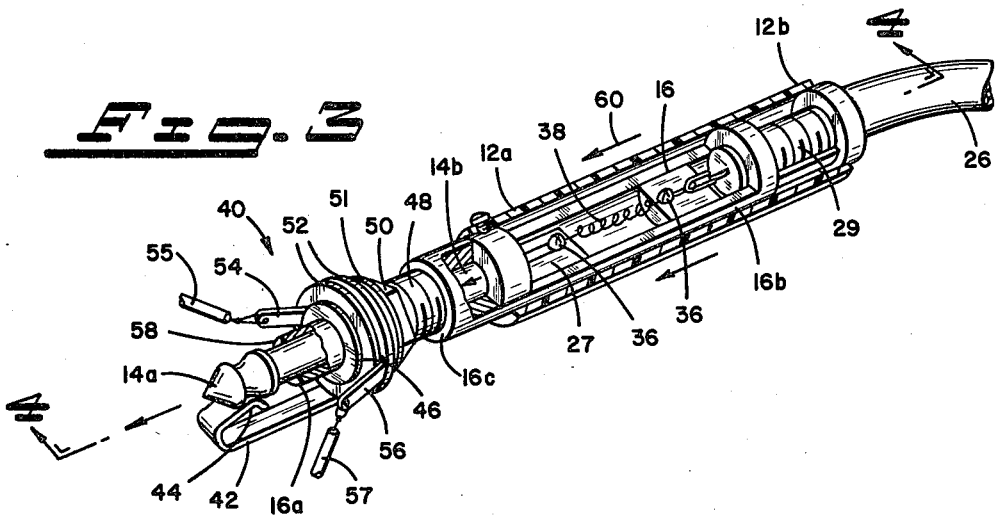
FIG. 3 is a partially cut-away perspective view of the first embodiment showing the connector plug joined to an associated jack.
Figure 4:
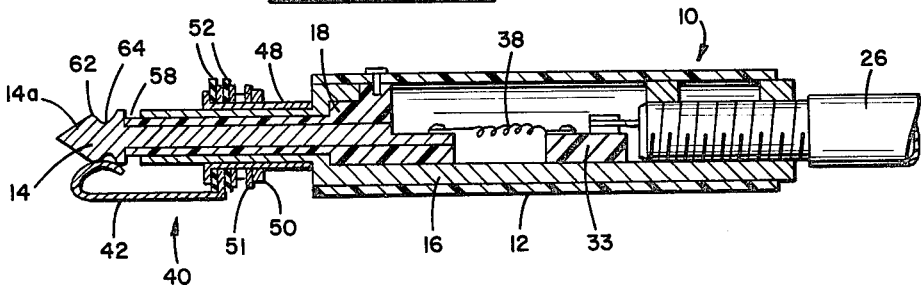
FIG. 4 is a cross-sectional view of FIG. 3 taken along lines 4—4 showing the internal aspects of the first embodiment when joined to an associated jack.

Referring now to FIGS. 3 and 4, one can see that the plug 10 has been inserted into an associated jack 40. Jack 40 has a spring-like contact arm 42 which engages the distal end 14*a* of the first electrode 14. To further insure a good contact between the contact arm 42 and the distal end 14*a*, distal end 14*a* has an outwardly extending rim 62 and an inwardly extending groove 64. Rim 62 engages a shaped contact section 44 on arm 42 which yieldably engages end 14*a* and extends into the groove 64.

The jack 44 also has a tubular contact sleeve 46 through which the first and second electrodes 14 and 16 extend. Contact sleeve 46 is electrically isolated from the contact arm 42, and has a threaded end 48 which enables bolt 50 and washer 51 to be disposed thereabout. This aids in the joining of the jack 40 to any associated device such as a guitar, amplifier or the like. In order to insure electrical isolation between the contact arm 42 and the tubular contact sleeve 46, annular insulating rings 52 are also circumferentially disposed about the contact sleeve 46. One end of contact arm 42 is sandwiched between rings 52 and is thus electrically isolated both from sleeve 46 and from contact post 54. The tubular contact sleeve 46 is, in turn, joined to contact post 54 and associated wire 55.

A more detailed explanation of the operation of the first embodiment of the present invention will now be presented. Referring to FIGS. 1–4, one can see that in the initial or rest position, the first and second electrodes 14 and 16, respectively, are in direct contact adjacent distal ends 14*a* and 16*a*. To help insure good contact and to maintain end 14*a* beyond end 16*a*, end 14*a* is formed with a flared rim. Contact is also maintained by the action of spring 38.

Circumferentially surrounding electrode 14 is tubular insulator 18. Insulator 18 may be made of any non-conductive material as is well known in the art. Insulator 18 has flared should sections 24 and 25 which are separated from the electrode 16 adjacent section 16*c*. While section 27 of insulator 18 covers electrode 14, a portion is removed so as to permit spring 28 to be electrically joined to electrode 18. Body 12 is also joined to the insulator 20 on shoulder 25 by means of screw member 31 or the like. Thus, sliding the elongated body 12 toward the distal ends 14*a* and 16*a* causes both the first electrode 14 as well as the insulator 18 to be moved relative to the second electrode 16.

Upon insertion of the first embodiment of plug 10 into the jack 40, the contact between the distal end 14*a* and the distal end 16*a* is maintained. Continued movement of the plug 10 will cause the contact sleeve 40, and more specifically, the threaded end 48 to ultimately engage the flared shoulder section 16*c* of the electrode 16. At this point, further movement of the plug 10 toward jack 40 causes the contact tip 14*a* of the first electrode 14 to disengage the distal end 16*a* of the second electrode 16. This is due to the sliding action between the body 12 and the second electrode 16 and because body 12 is joined to insulator 18. Movement of insulator 18 also moves electrode 14. In this manner, the distal end 14*a* of the first electrode 14 pushes against and thereby engages the contact arm 42. Further movement against contact arm 42 causes the shaped contact section 44 to slide up over the rim 60 into the groove 64 thus securely engaging the distal end 14*a* of the first electrode 14.

Referring to FIGS. 3 and 4, one can see that after engagement between the contact arm 42 and the first electrode 14 has been achieved, there is a gap 58 formed between the distal ends 14*a* and 16*a* of the first and second electrodes 14 and 16, respectively. Because the distal ends remain in abutting contact during insertion, however, there are no problems with any undesirable feedback being created during the insertion procedure. Further, at that point in time when the first and second electrodes are separated, the separation occurs relatively quickly as the first and second electrodes 14 and 16 do not slidingly disengage from one another; rather, they instantaneously move apart from one another since the distal end 14*a* only electrically contacts the second electrode 16 at the end thereof. Thus, electrical disengagement occurs almost instantaneously. It is to be understood that while electrodes 14 and 16 may be joined together as part of a circuit by means of contact arms 54 and 56 and wires 55 and 57, there is no direct electrical conduction adjacent the distal ends 14*a* and 16*a* thereof.

The second embodiment of the present invention will now be disclosed and described with reference to FIGS. 5–8.

Figure 5:
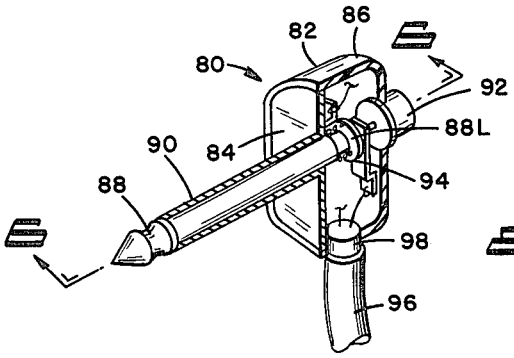
FIG. 5 is a partially cut-away perspective view of a second embodiment of the connector plug of the present invention.
Figure 6:
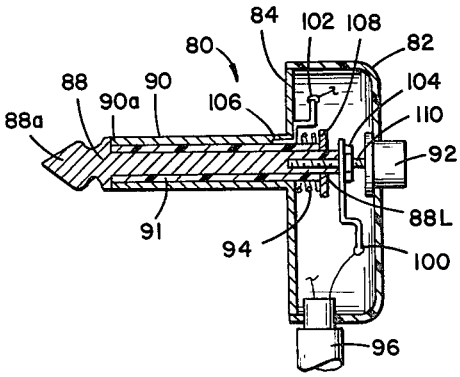
FIG. 6 is a cross-sectional view of FIG. 5 taken along line 6—6 showing the internal aspects of the second embodiment of the present invention.

Referring specifically to FIGS. 5 and 6, one can see plug 80 which forms the second embodiment of the present invention. Plug 80 is comprised of a non-conductive body or case 82 which has a first metal plate section 84 and a second non-conductive plastic housing section 86. Extending outwardly from the first section 84 and formed integrally therewith is a second tubular electrode 90. Axially disposed within and slideable with respect thereto is a first rod-like electrode 88. As with the first embodiment, in the second electrode in order to electrically isolate the first electrode 88 from the second electrode 90, an elongated insulator member 91 is disposed along the length and circumferentially surrounds the first electrode 88. In the second embodiment of the present invention, movement of the first electrode 88 relative to the second electrode 90 is achieved by means of a button member 92 connected to the first electrode 88. Located between button 92 and electrode 88 is a spring 94 axially disposed about the proximal end 88*b* of the first electrode 88. Spring 94 is journaled between an insulating ring 108 and a ledge 106 formed in an internal wall of the second electrode 90. To insure that there is no contact between the spring 94 and the first electrode 88, as can be seen in the Figures, spring 94 is also circumferentially disposed about insulator 91. The force of the spring 94 on the insulator ring 108 urges the distal end 88*a* of the first electrode 88 against the distal end 90*a* of the second electrode 90.

Extending through an opening 98 formed in the housing 86 is cable 96. Cable 96 has a similar construction to cable 26, i.e. an exterior non-conductive sheath, and first and second conductors 100 and 102 located therein. Conductors 100 and 102 are electrically joined to contact arms 100*a* and 102*a*, respectively. To position contact arm 100*a* and to insure good contact between arm 100 and the first electrode 88, one can see that a nut 104 and associated screw rod 110 extend into the first electrode 88. Contact with the second electrode 90 by the contact arm 102*a* is achieved by, in one embodiment, press fitting contact arm 102*a* directly onto the metal plate section 84. It is to be understood, of course, the other means for electrically coupling the cable 96 to the first and second electrodes 88 and 90 are also within the scope of this invention.

Figure 7:
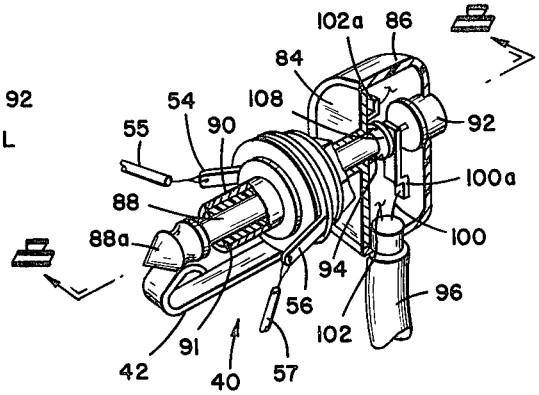
FIG. 7 is a partially cut-away perpective view of the second embodiment showing the plug joined to an associated jack.
Figure 8:
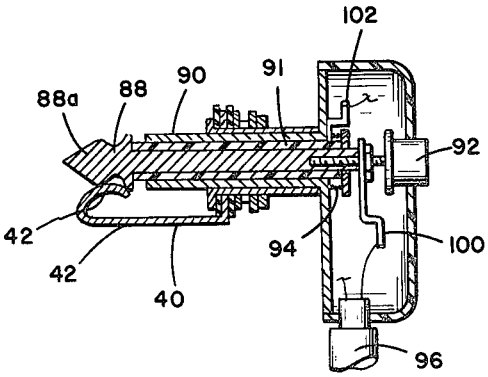
FIG. 8 is a cross-sectional view of FIG. 7 taken along lines 8—8 showing the internal aspects of the second embodiment when joined to an associated jack.

Referring now specifically to FIGS. 7 and 8, one can see that the plug 80 has been joined to associated jack 40. While other jacks could be used, jack 40 is the same as that described with respect to the first embodiment of the present invention. Upon insertion of plug 80 into jack 40, the first and second electrodes 88 and 90 would be in abutting contact at the respective distal ends 88*a* and 90*a* thereof. Thus, there still would be no electrical impulses sent back through cable 96 to the amplifier or similar sound system as contact between electrodes 88 and 90 shorts out such impulses. In order to actuate the device of the second embodiment of the present invention, one would have to press button 96 with sufficient force to overcome resistance of spring 44. This causes the proximal end 88*a* of electrode 88 to separate from the proximal end 90*b* as shown in FIGS. 7 and 8. Upon separation, the contact arm 42 would then move up into the groove formed on the distal end 88*a* of the first electrode so as to securely contact the same. This is more fully discussed above with respect to the first embodiment. To remove plug 80 from jack 40, one would merely grasp the plug 80 and pull away from the jack 40. When distal end 88*a* disengages the contact arm 42, action of spring 94 would encourage the first electrode 88 back against the distal end 90*a* of the second electrode 90. Thus, during insertion or removal of the second embodiment of the present invention, problems associated with feedback are also substantially eliminated.

While the invention has been described in its preferred embodiments, it is to be understood that the words which have been used are words of description rather than of limitation and that changes within the purview of the appended claims may be made without departing from the true scope and spirit of the invention in its broader aspects. For example, in the first embodiment, spring 38 urges the first and second electrodes 14 and 16 together at their respective ends. Other configurations for spring 38 and other urging means are within the scope of the present invention. Further, the first electrode 14 could be fixed in position while electrode 16 is caused to move. Similarly, changes could also be made in the second embodiment.

The scope of the invention, therefore, is not intended to be limited to the specific embodiments described, but rather by the appended claims.

We claim:

1. A phone plug having special utility in the electrical musical instrument field, comprising:

a body;

a tubular electrode configured for insertion into an associated jack and extending outwardly from the body;

a second electrode having a rod shaped portion slidably disposed in the tubular electrode and a contact tip connected to the distal end of the rod shaped portion and extending from the distal end of the tubular electrode, said rod shaped portion being electrically isolated from the tubular electrode along the length thereof;

bias means for normally biasing the contact tip against the distal end of the tubular electrode, thereby shorting the phone plug; and activation means for disengaging the contact tip from the tubular electrode when the plug is inserted into an associated jack to thereby remove said short.

2. A plug according to claim 1 wherein said plug includes means for joining said tubular and second electrodes to a source of electrical energy.

3. A plug according to claim 1 wherein said rod shaped portion has a non-conductive tubular insulator disposed along the length thereof, said insulator electrically isolating said rod shaped portion along the length thereof from the tubular electrode.

4. A plug according to claim 3 wherein: the body is slidable about the tubular electrode;

the insulator includes a base member located within and coupled to the body to move in conjunction therewith; and movement of the insulator controls the movement of the contact tip, whereby when the plug is inserted into an associated jack, movement of the body with respect to the tubular electrode will cause the contact tip to disengage from the tubular electrode, said body and base member together comprising said activation means.

5. A plug according to claim 1 wherein said bias means comprises a spring member joined to said rod shaped portion.

6. A phone plug having special utility in the electrical musical instrument field, comprising:

a non-conductive, tubular body having a rod shaped electrode disposed in a fixed position in said body, said rod shaped electrode having a contact tip adjacent the distal end thereof, a tubular electrode slidably disposed in said body, circumferentially disposed about said rod shaped electrode and electrically isolated therefrom along the length of the rod shaped electrode, said electrodes slidably movable with respect to each other; and bias means for biasing the contact tip and distal end of the tubular electrode into engagement such that when said plug is joined to an associated jack, movement of the body with respect to the tubular electrode will overcome the force of the bias means and cause the contact tip and distal end of the tubular electrode to selectively disengage so as to electrically isolate the contact tip from the tubular electrode.

7. A plug according to claim 6 wherein said rod shaped electrode has a tubular insulator along the length thereof.

8. In a connector plug having a body section, a tubular electrode extending from the body section and a rod shaped electrode extending from the body coaxial with the tubular electrode, said rod shaped electrode being electrically insulated from the tubular electrode along its length and having a contact tip extending from the end of the tubular electrode, the improvement wherein said rod shaped electrode is slidable within said tubular electrode and including:

means for normally biasing the contact tip against the end of the tubular electrode, thereby shorting the two electrodes; and means for forcing the contact tip away from engagement with the end of the tubular electrode when the plug is inserted into an associated jack, wherein said means for forcing includes the body, said body comprising a sleeve which is slidable with respect to the tubular electrode and fixed with respect to the rod shaped electrode, whereby the sleeve slides forward with respect to the tubular electrode upon insertion of said plug into a jack, thereby separating the contact tip from the distal end of the tubular electrode.

* * * * *